US010236602B2

(12) United States Patent
Palau et al.

(10) Patent No.: US 10,236,602 B2
(45) Date of Patent: Mar. 19, 2019

(54) L-SHAPED PCB TERMINAL

(71) Applicant: Lear Corporation, Southfield, MI (US)

(72) Inventors: Joan I. F. Palau, Valls (ES); Luis M. Munoz, Valls (ES); Elena Cortes, Valls (ES); Ferran J. Ribas, Valls (ES)

(73) Assignee: Lear Corporation, Southfield, MI (US)

( * ) Notice: Subject to any disclaimer, the term of this patent is extended or adjusted under 35 U.S.C. 154(b) by 0 days.

(21) Appl. No.: 14/627,190

(22) Filed: Feb. 20, 2015

(65) Prior Publication Data

US 2016/0248191 A1 Aug. 25, 2016

(51) Int. Cl.

| | |
|---|---|
| ***H01R 43/20*** | (2006.01) |
| ***H01R 12/58*** | (2011.01) |
| *H01R 12/71* | (2011.01) |

(52) U.S. Cl.

CPC ..... *H01R 12/58* (2013.01); *H01R 12/716* (2013.01); *Y10T 29/49208* (2015.01)

(58) Field of Classification Search

CPC ..... Y10T 29/49208; Y10T 29/49204; Y10T 29/49117; Y10T 29/49002; H01R 13/518; H01R 43/18; H01R 12/7076

USPC ..... 29/876, 874, 825, 592.1

See application file for complete search history.

(56) References Cited

U.S. PATENT DOCUMENTS

| | | | | |
|---|---|---|---|---|
| 3,154,631 | A | 10/1964 | Mauviel | |
| 5,076,795 | A | 12/1991 | Krupp et al. | |
| 5,340,320 | A | 8/1994 | Puerner | |
| 5,358,413 | A | 10/1994 | Daly et al. | |
| 5,453,016 | A | 9/1995 | Clark et al. | |
| 5,702,257 | A | 12/1997 | Millhimes | |
| 5,947,754 | A * | 9/1999 | Lin | H01R 12/58 439/79 |
| 6,106,308 | A | 8/2000 | Chen et al. | |
| 7,201,587 | B1 | 4/2007 | Eichorn et al. | |
| 8,011,936 | B2 * | 9/2011 | Goto | H05K 7/026 439/341 |

(Continued)

FOREIGN PATENT DOCUMENTS

| | | |
|---|---|---|
| CN | 201956471 | 11/2010 |
| CN | 104348003 | 2/2015 |

OTHER PUBLICATIONS

Chinese Patent Office, Office Action for Chinese Patent Application No. 2016100934014, dated Sep. 30, 2017, with Machine Translation attached, 17 pages.

*Primary Examiner* — Peter DungBa Vo
*Assistant Examiner* — Azm Parvez
(74) *Attorney, Agent, or Firm* — Fishman Stewart PLLC

(57) ABSTRACT

The present disclosure includes a method of assembling a power distribution box, that may include providing a circuit board and providing a first L-shaped terminal. The first L-shaped terminal may include a horizontal portion and a vertical portion. A second L-shaped terminal may include a horizontal portion and a vertical portion. In embodiments, the first terminal and/or the second terminal may be inserted into the circuit board such that the horizontal portion of the second terminal may be disposed above the horizontal portion of the first terminal with an air gap between the horizontal portion of the first terminal and the horizontal portion of the second terminal. A power distribution box cover may include a recess that may be configured to receive the first terminal and the second terminal without contacting the first terminal.

20 Claims, 8 Drawing Sheets

(56) References Cited

U.S. PATENT DOCUMENTS

| | | | | |
|---|---|---|---|---|
| 8,057,240 | B2 | 11/2011 | Morgan | |
| 2002/0031930 | A1* | 3/2002 | Metz | H01R 13/193<br>439/161 |
| 2004/0018757 | A1* | 1/2004 | Lang | H01R 13/514<br>439/82 |
| 2009/0253298 | A1* | 10/2009 | Kameyama | H01R 12/724<br>439/607.41 |

* cited by examiner

L-SHAPED PCB TERMINAL

TECHNICAL FIELD

The present disclosure relates to electrical components, including electrical connectors and/or electrical terminals.

SUMMARY

The present disclosure includes a method of assembling a power distribution box that may comprise providing a circuit board and providing a first L-shaped terminal. In embodiments, the first L-shaped terminal may include a horizontal portion and a vertical portion. In embodiments, assembling a power distribution box may include providing a second L-shaped terminal and the second L-shaped terminal may include a horizontal portion and a vertical portion. In embodiments, assembling a power distribution box may include inserting the first terminal into the circuit board and/or inserting the second terminal into the circuit board such that the horizontal portion of the second terminal may be disposed above the horizontal portion of the first terminal with an air gap between the horizontal portion of the first terminal and the horizontal portion of the second terminal. In embodiments, assembling a power distribution box may include providing a power distribution box cover and the cover may include a recess that may be configured to receive the first terminal and the second terminal without contacting the first terminal.

In embodiments, a circuit board assembly may comprise a circuit board and a first L-shaped terminal that may be connected to the circuit board. In embodiments, the first L-shaped terminal may include a horizontal portion and a vertical portion. In embodiments, a second L-shaped terminal may be connected to the circuit board and the second L-shaped terminal may include a horizontal portion and a vertical portion. In embodiments, the first terminal and the second terminal may be connected to the circuit board such that the horizontal portion of the second terminal may be disposed above the horizontal portion of the first terminal with an air gap between the horizontal portion of the first terminal and the horizontal portion of the second terminal.

DETAILED DESCRIPTION

Figure 1A:
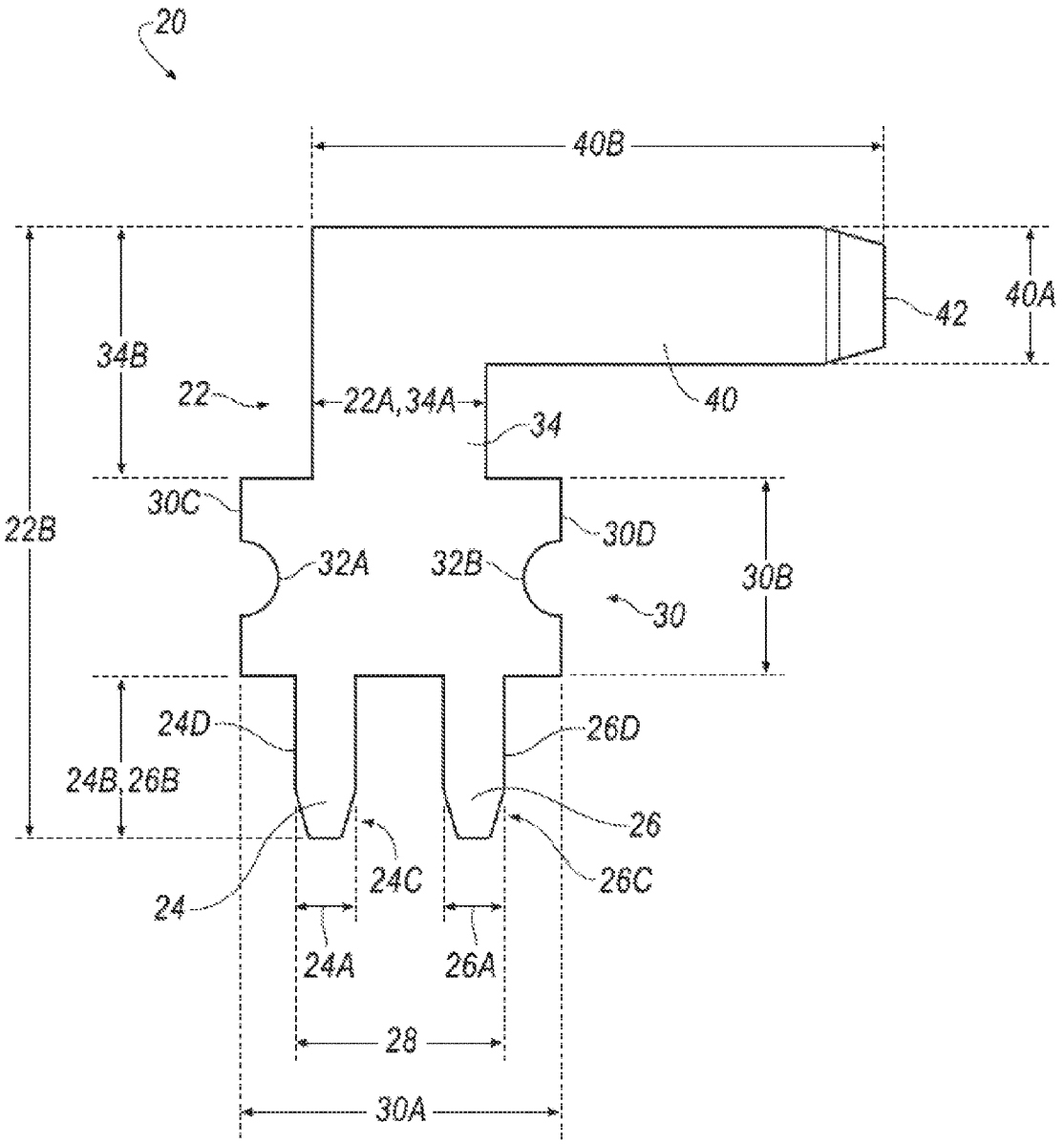
FIG. 1A is a side view of embodiments of an L-shaped terminal in accordance with teachings of the present disclosure.
Figure 1C:
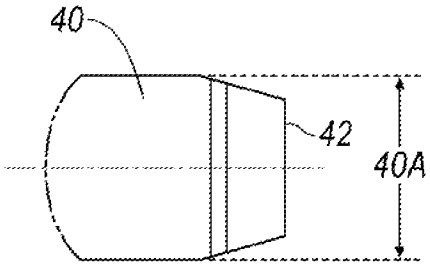
FIGS. 1C-1F are side views of embodiments of an L-shaped terminal in accordance with teachings of the present disclosure.
Figure 1F:
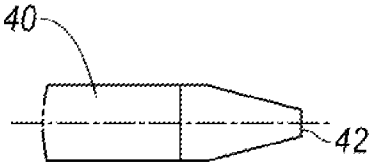
Figure 1D:
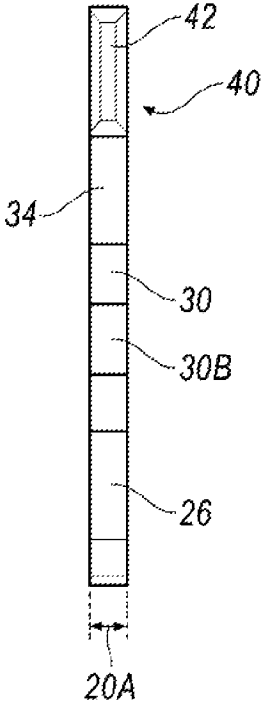
Figure 1B:
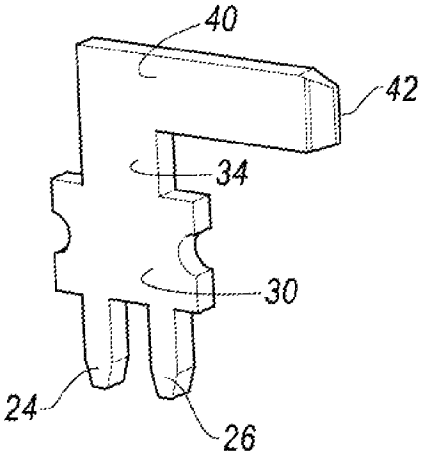
FIG. 1B is a perspective view of an embodiment of an L-shaped terminal in accordance with teachings of the present disclosure.

Reference will now be made in detail to embodiments of the present disclosure, examples of which are described herein and illustrated in the accompanying drawings. While the present disclosure will be described in conjunction with embodiments and/or examples, it will be understood that they are not intended to limit the present disclosure to these embodiments and/or examples. On the contrary, the present disclosure is intended to cover alternatives, modifications and equivalents, which may be included within the spirit and scope of the present disclosure.

In embodiments, such as generally illustrated in FIGS. 1A-1F and 3A, a first electrical terminal 20 may include a first portion 22 and/or a second portion 40. In embodiments, electrical terminal 20 may be configured as a blade-type terminal, which may include first portion 22 and/or second portion 40 being configured as blades. First portion 22 may be referred to herein as vertical portion 22 and/or may be configured for vertical insertion into a circuit board 50 (see, e.g., FIG. 3A). In embodiments, vertical portion 22 may include a width 22A. In embodiments, vertical portion 22 may include one or more protrusions 24, 26 that may be configured for insertion into circuit board 50. For example, and without limitation, vertical portion 22 may include two protrusions 24, 26 that may each correspond to an aperture $\mathbf{52}_N$ (e.g., apertures $\mathbf{52}_1$, $\mathbf{52}_2$) in circuit board 50 (see, e.g., FIG. 3A). Protrusions 24, 26 may include widths 24A, 26A, the maximums of which may be about the same as, smaller than, or larger than (e.g., for an interference fit) corresponding apertures $\mathbf{52}_N$. In embodiments, the lengths 24B, 26B of protrusions 24, 26 may be sufficiently greater than the thickness 50A of circuit board 50 such that, upon insertion, at least some portions of protrusions 24, 26 extend beyond the bottom 54 of circuit board 50. In embodiments, protrusions 24, 26 may include tapered areas 24C, 26C that may simplify insertion of protrusions 24, 26 into apertures $\mathbf{52}_N$. In embodiments, lengths 24B, 26B of protrusions 24, 26 may be sufficiently long such that, upon insertion, tapered areas 24C, 26C are entirely below bottom 54 of circuit board 50. In embodiments, protrusions 24, 26 may be disposed parallel to each other and/or may extend generally vertically downward (e.g., relative to horizontal portion 40 and/or circuit board 50).

In embodiments, vertical portion 22 may include a middle section 30 that may be configured for helping to maintain a position of first terminal 20 relative to circuit board 50 (e.g., a perpendicular position). Middle section 30 may include a width 30A, the maximum of which may be greater than maximums of width(s) of the remainder of vertical portion 22 (e.g., greater than width 34A of top section 34, and/or a distance 28 between outer sides 24D, 26D of protrusions 24, 26). In embodiments, middle section 30 may include one or more recessed portions 32A, 32B that may be disposed on opposite vertical sides 30C, 30D of middle section 30. Recessed portions 32A, 32B may include one or more of a variety of shapes, sizes, and/or configurations, which may include, for example, having a generally semi-circular shape. In embodiments, the length(s) 24B, 26B of protrusions 24, 26 may be configured such that upon insertion, middle section 30 is disposed against the top surface/top side 56 of circuit board 50. In embodiments, protrusions 24, 26 may extend from middle section 30 and may extend such that outer sides 24D, 26D of protrusions 24, 26 may be disposed laterally outside of the top section 34 of vertical portion 22 (e.g., a distance 28 between outer sides 24D, 26D of protrusions may be greater than the maximum width 34A of top section 34).

In embodiments, second portion 40 may be referred to herein as horizontal portion 40 and/or may extend horizontally from vertical portion 22 (e.g., at a right angle from) such that vertical portion 22 and horizontal portion 40 form a generally L-shaped configuration. Horizontal portion 40 may be configured for connection with an external connector 100, which may include, for example, a wiring harness connector. For example, and without limitation, the height 40A of horizontal portion 40 may correspond to (e.g., be about the same as or smaller than) an aperture 102 of external connector 100. In embodiments, the height 40A of horizontal portion 40 may be less than the maximum width 34A of middle section 30 and/or top section 34 of vertical portion 22. For example, and without limitation, horizontal portion 40 may include a height 40A of about 2.8 mm, middle section 30 of vertical portion 22 may include a maximum width of about 6.5 mm, and/or top section 34 of vertical portion 22 may include a width 34A of about 3.5 mm.

In embodiments, such as generally illustrated in FIGS. 2A-2F, a second terminal 60 may include a similar configuration as first terminal 20, which may include having a vertical portion 62 and/or a horizontal portion 80 that may extend perpendicularly from vertical portion 62. In embodiments, electrical terminal 60 may be configured as a blade-type terminal, which may include vertical portion 62 and/or horizontal portion 80 being configured as blades. Second terminal vertical portion 62 may include a middle section 70 that may include recessed portions 72A, 72B that may include generally semi-circular shapes provided in vertical sides 70C, 70D of middle section 70. In embodiments, vertical portion 62 may include one or more protrusions 64, 66 that may be configured for insertion into circuit board 50. Protrusions 64, 66 may include widths 64A, 66A, lengths 64B, 66B, and/or tapered areas 64C, 66C. For example, and without limitation, protrusions 64, 66 may each correspond to an aperture $\mathbf{52}_N$ (e.g., apertures $\mathbf{52}_3$, $\mathbf{52}_4$) in circuit board 50 (see, e.g., FIG. 3B). In embodiments, middle section 70 may include a width 70A that may be greater than maximum width(s) of the remainder of vertical portion (e.g., wider than the width 74A of top section 74 or greater than a distance 68 between outer sides 64D, 66D of protrusions 64, 66). In embodiments, the length(s) 64B, 66B of protrusions 64, 66 (which may or may not be the same) may be configured such that upon insertion, middle section 70 is disposed against the surface 56 of circuit board 50. In embodiments, protrusions 64, 66 may extend from middle section 70 and may extend such that outer sides 64D, 66D of protrusions 64, 66 are disposed laterally outside of top section 74 of vertical portion 62 (e.g., distance 68 between outer sides 64D, 66D of protrusions 64, 66 may be greater than the width 74A of top section 74).

In embodiments, the height 80A of horizontal portion 80 and width 62A of vertical portion 62 may be the same or similar to horizontal portion 40 and vertical portion 22 of first terminal 20, respectively. For example, and without limitation, horizontal portion 80 may include a height 80A of about 2.8 mm, top section 74 of vertical portion 62 may include a width 74A of about 3.5 mm, and/or middle section 70 of vertical portion 62 may include a maximum width 70A of about 6.5 mm.

Figure 1E:
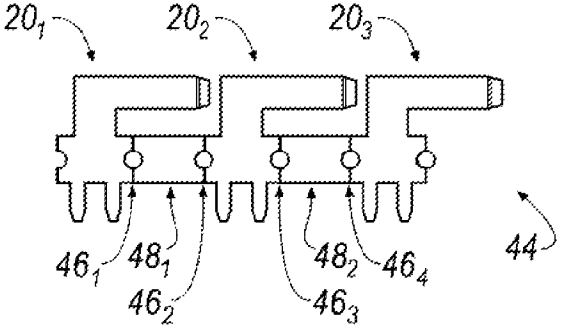
Figure 2A:
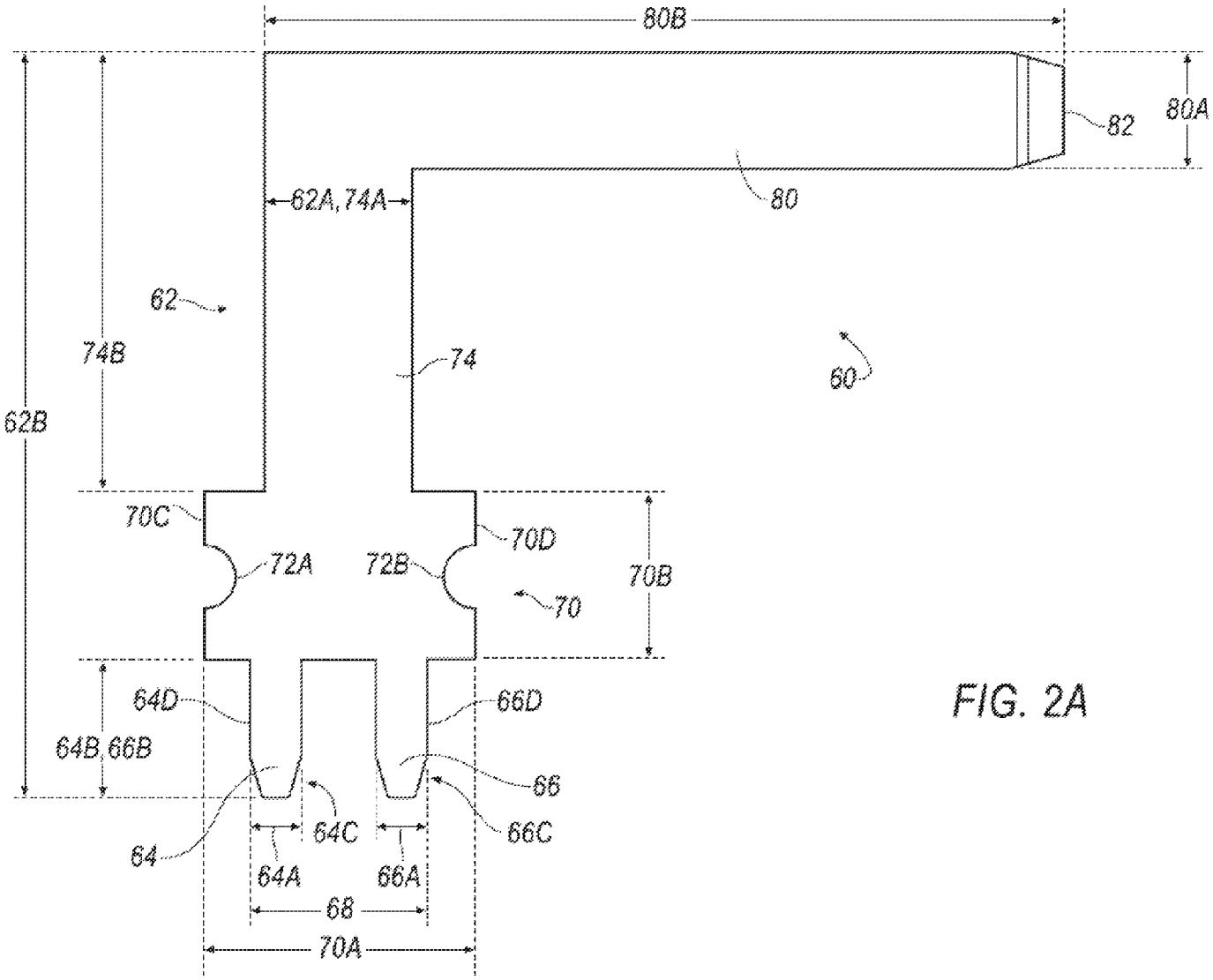
FIG. 2A is a side view of embodiments of an L-shaped terminal in accordance with teachings of the present disclosure.
Figure 2C:
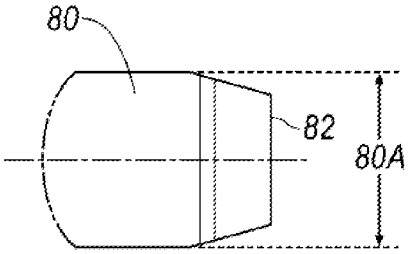
FIGS. 2C-2F are side views of embodiments of an L-shaped terminal in accordance with teachings of the present disclosure.
Figure 2F:
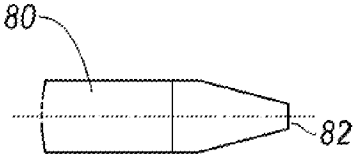
Figure 2D:
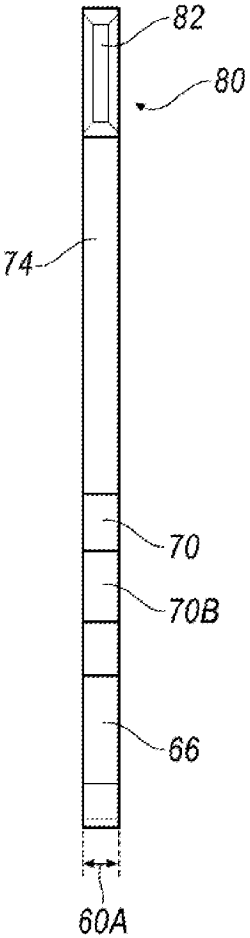
Figure 2B:
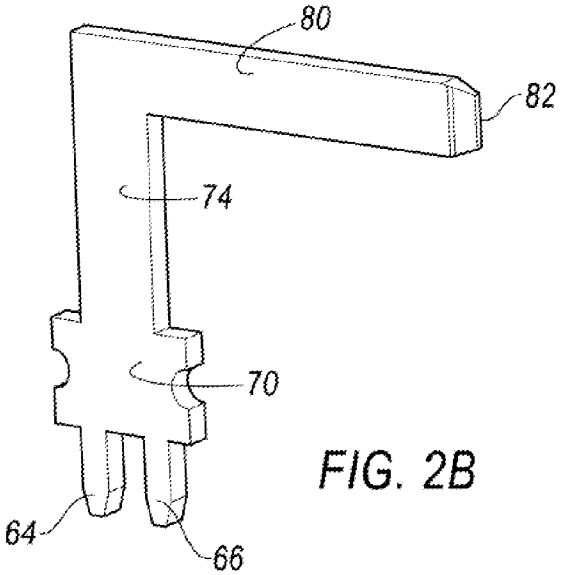
FIG. 2B is a perspective view of an embodiment of an L-shaped terminal in accordance with teachings of the present disclosure.
Figure 2E:
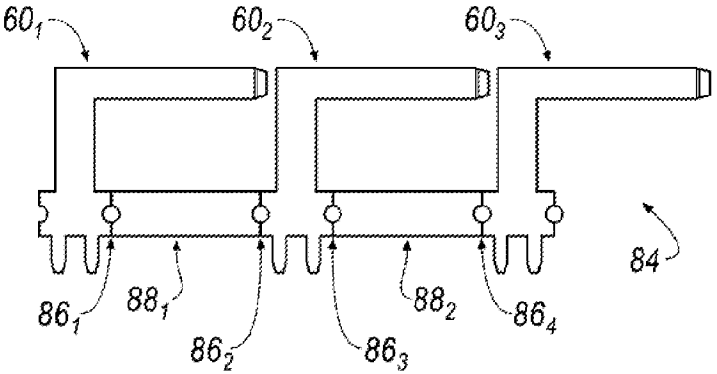

In embodiments, such as generally illustrated in FIGS. 1E and 2E, a plurality of first terminals $\mathbf{20}_N$ (e.g., $\mathbf{20}_1$, $\mathbf{20}_2$, $\mathbf{20}_3$) and/or a plurality of second terminals $\mathbf{60}_N$ (e.g., $\mathbf{60}_1$, $\mathbf{60}_2$, $\mathbf{60}_3$) may be formed as chains 44, 84 of terminals. The chains 44, 84 may be rolled for distribution. The chains 44, 84 may include predetermined separation areas $\mathbf{46}_N$ (e.g., $\mathbf{46}_1$, $\mathbf{46}_2$, $\mathbf{46}_3$, $\mathbf{46}_4$) and/or separation areas $\mathbf{86}_N$ (e.g., $\mathbf{86}_1$, $\mathbf{86}_2$, $\mathbf{86}_3$, $\mathbf{86}_4$) for separating terminals $\mathbf{20}_N$, $\mathbf{60}_N$ from each other. In embodiments, adjacent terminals (e.g., terminals $\mathbf{20}_1$, $\mathbf{20}_2$ or terminals $\mathbf{60}_1$, $\mathbf{60}_2$) may be connected by a disposable intermediate portion $\mathbf{48}_N$ (e.g., $\mathbf{48}_1$, $\mathbf{48}_2$) and/or disposable intermediate portion $\mathbf{88}_N$ (e.g., $\mathbf{88}_1$, $\mathbf{88}_2$) that may be formed of the same material as the terminals $\mathbf{20}_N$, $\mathbf{60}_N$.

Figure 3A:
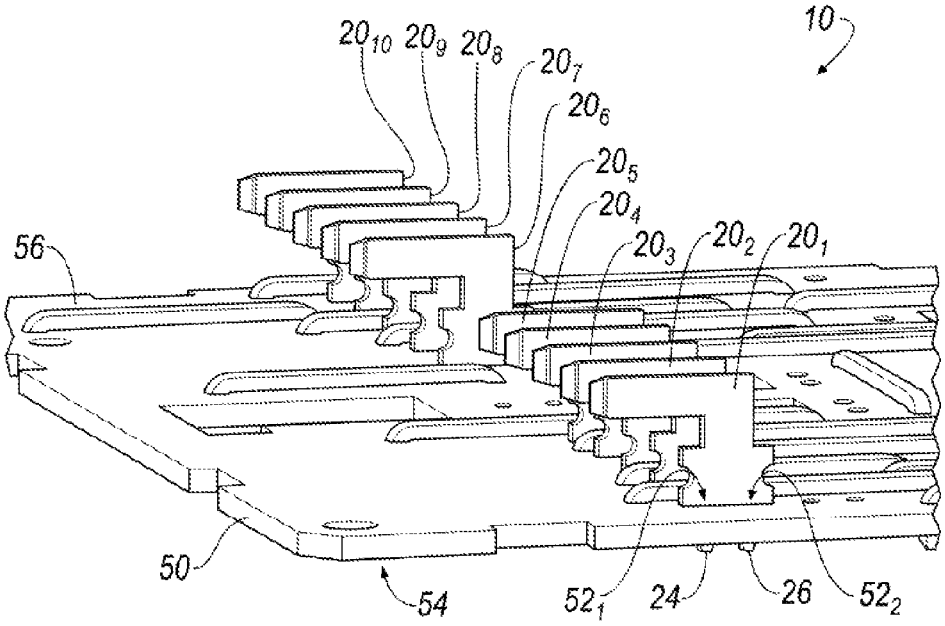
FIGS. 3A-3D are perspective views of an embodiment of portions of a power distribution box in accordance with teachings of the present disclosure.
Figure 3B:
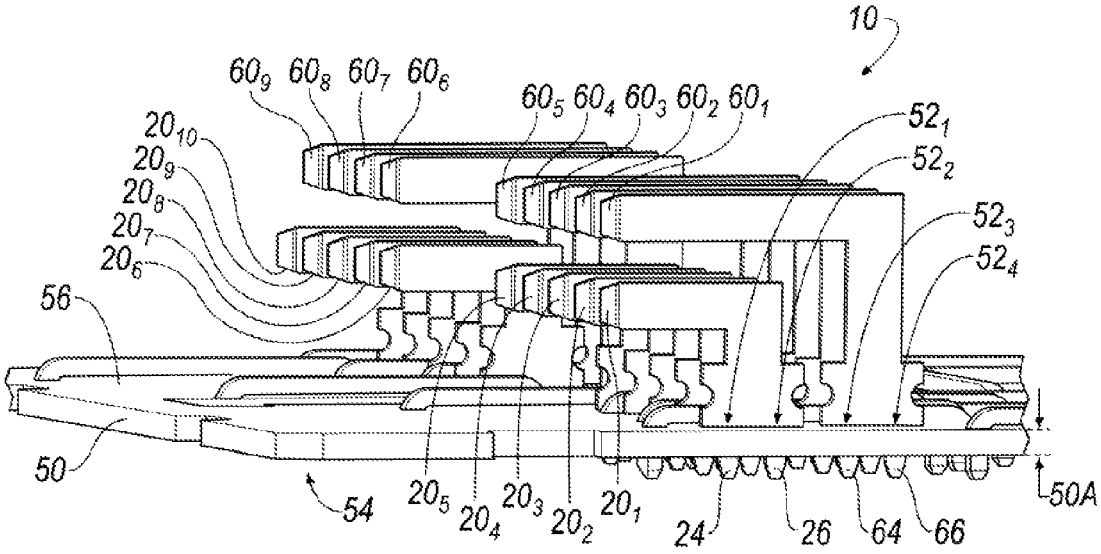
Figure 3C:
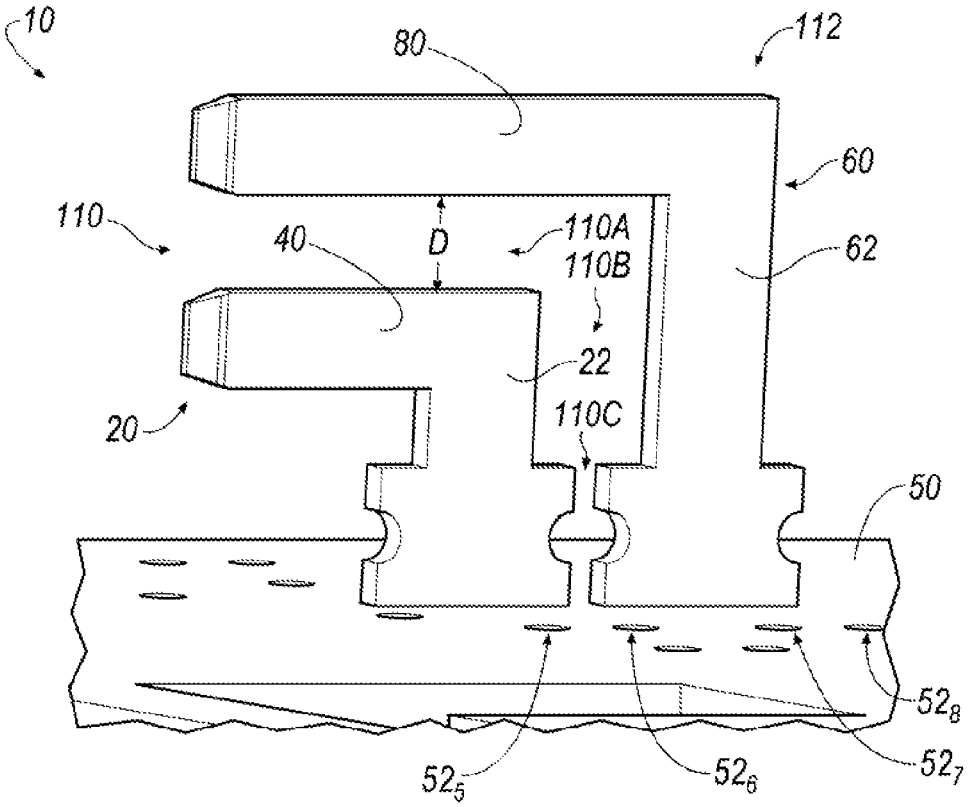
Figure 3D:
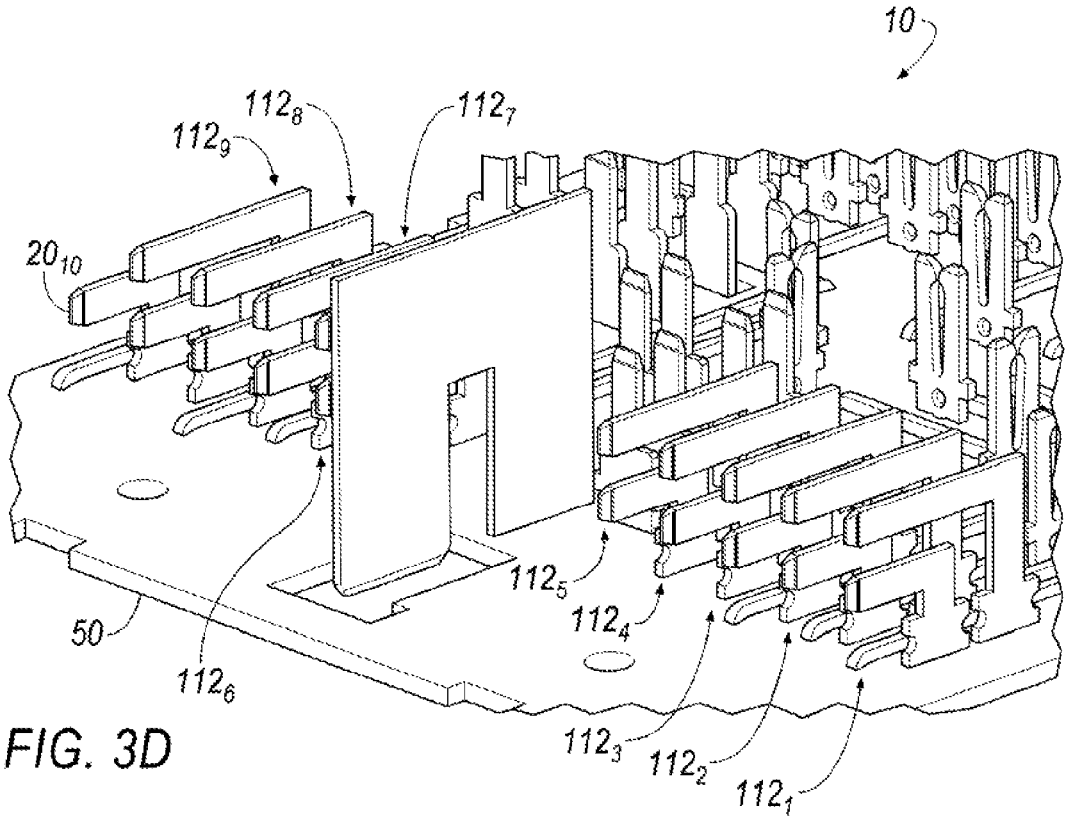

In embodiments, such as generally illustrated in FIGS. 3B-3D, vertical portion 62 of second terminal 60 may be longer than vertical portion 22 of first terminal 20 and/or horizontal portion 80 of second terminal 60 may be longer than horizontal portion 40 of first terminal 20. For example, and without limitation, vertical portion 62 of second terminal 60 may include a length 62B of about 17.9 mm, which may include middle section 70 having a length 70B of about 4 mm, top section 74 having a length 74B of about 10.6 mm, and/or protrusions 64, 66 each having a length 64B, 66B of about 3.3 mm. In embodiments, for example only, vertical portion 22 of first terminal 20 may include a length 22B of about 12.4 mm, which may include middle section 30 having a length 30B of about 4 mm, top section 34 having a length 34B of about 5.1 mm, and/or protrusions 24, 26 each having a length 24B, 26B, respectively, of about 3.3 mm. In embodiments, for example only, horizontal portion 80 of second terminal 60 may include a length 80B of 19.2 mm and/or horizontal portion 40 of first terminal 20 may include a length 40B of 11.5 mm.

In embodiments, a longer vertical portion 62 of second terminal 60 (e.g., relative to vertical portion 22 of first terminal 20) may permit second terminal 60 to be inserted into circuit board 50 such that horizontal portion 80 of second terminal 60 may be positioned above horizontal portion 40 of first terminal 20. A difference between lengths 22B, 62B of vertical portions 22, 62 of first and second terminals 20, 60 may correspond to a distance D between horizontal portions 40, 80 of first and second terminals 20, 60. The distance D may or may not be occupied by any other component and/or may be a gap, e.g., generally illustrated as gap 110, which may be an air gap. Gap 110 may extend between all or part of vertical portions 22, 62 and/or horizontal portions 40, 80. For example, and without limitation, a first section 110A of gap 110 may extend along the entire length 40B of horizontal portion 40 of first terminal 20 and/or the entire length 80B of horizontal portion 80 of second terminal 60. In embodiments, a second section 110B of gap 110 may extend between vertical portion 22 of first terminal 20 and vertical portion 62 of second terminal 60, and/or a third section 110C of gap 110 may extend between middle sections 30, 70 of first and second terminals 20, 60. In embodiments, for example only, first section 110A of gap 110 may include a height of about 2.7 mm. In embodiments, second section 110B of gap 110 may be wider than first section 110A and third section 110C, and/or first section 110A may be wider than third section 110C.

In embodiments, horizontal portion 80 of second terminal 60 may be longer than horizontal portion 40 of first terminal 20. A longer horizontal portion 80 of second terminal 60 may permit horizontal portion 80 to be disposed over (e.g., aligned directly above and/or in a common vertical plane) all or part of horizontal portion 40 of first terminal 20. In embodiments, horizontal portion 40 of first terminal and/or horizontal portion 80 of second terminal may be generally planar and/or may be disposed such that they are generally perpendicular to top surface 56 of circuit board 50. In embodiments, circuit board 50 and/or top surface 56 may be generally planar. For example, and without limitation, horizontal portion 80 of second terminal 60 may extend over the entire length 40B of horizontal portion 40 of first terminal 20 such that ends 42, 82 of horizontal portions 40, 80 are generally vertically aligned and/or such that horizontal portions share a common vertical plane that is disposed perpendicularly to the plane of circuit board 50.

In embodiments, such as generally illustrated in FIGS. 3B and 3D, a circuit board 50, which may be provided to and/or provided in power distribution box 10, may include a plurality of sets $\mathbf{112}_N$ of terminals and each set may include a first terminal $\mathbf{20}_N$ and a second terminal $\mathbf{60}_N$. For example, and without limitation, circuit board 50 may include nine sets $\mathbf{112}_N$ (e.g., $\mathbf{112}_1$, $\mathbf{112}_2$, $\mathbf{112}_3$, $\mathbf{112}_4$, $\mathbf{112}_5$, $\mathbf{112}_6$, $\mathbf{112}_7$, $\mathbf{112}_8$, $\mathbf{112}_9$) of first terminals $\mathbf{20}_N$ (e.g., terminals $\mathbf{20}_1$, $\mathbf{20}_2$, $\mathbf{20}_3$, $\mathbf{20}_4$, $\mathbf{20}_5$, $\mathbf{20}_6$, $\mathbf{20}_7$, $\mathbf{20}_8$, $\mathbf{20}_9$) and second terminals $\mathbf{60}_N$ (e.g., terminals $\mathbf{60}_1$, $\mathbf{60}_2$, $\mathbf{60}_3$, $\mathbf{60}_4$, $\mathbf{60}_5$, $\mathbf{60}_6$, $\mathbf{60}_7$, $\mathbf{60}_8$, $\mathbf{60}_9$). In embodiments, such as generally illustrated in FIGS. 3D and 4B, one or more terminals may not be included as part of a set $\mathbf{112}_N$. For example, and without limitation, first terminal $\mathbf{20}_{10}$ may not correspond to a second terminal 60.

Figure 4A:
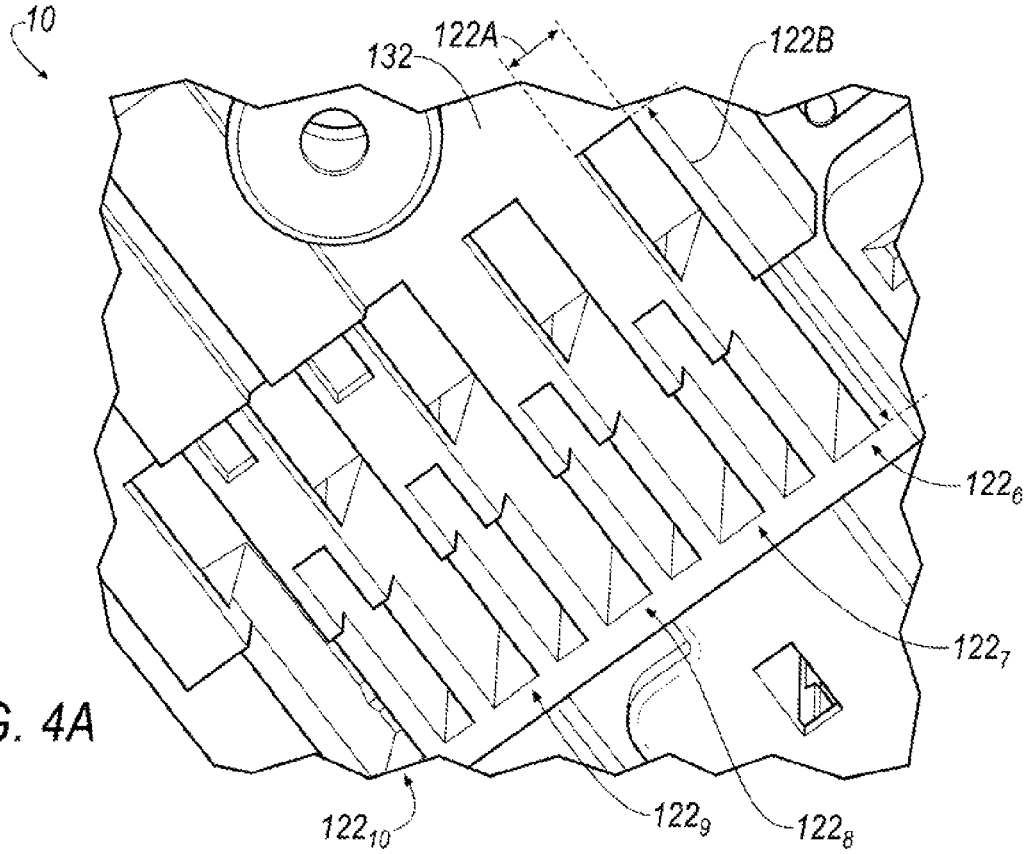
FIGS. 4A and 4B are perspective views of an embodiment of portions of a power distribution box in accordance with teachings of the present disclosure.
Figure 4B:
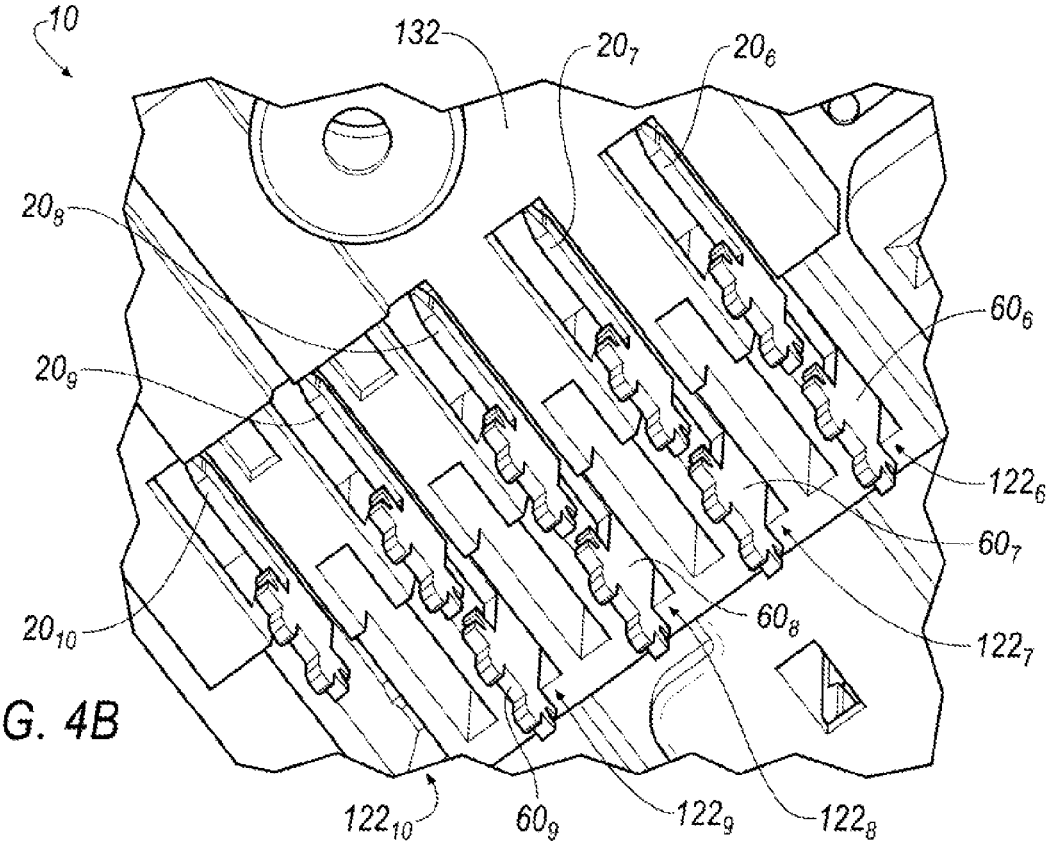
Figure 5A:
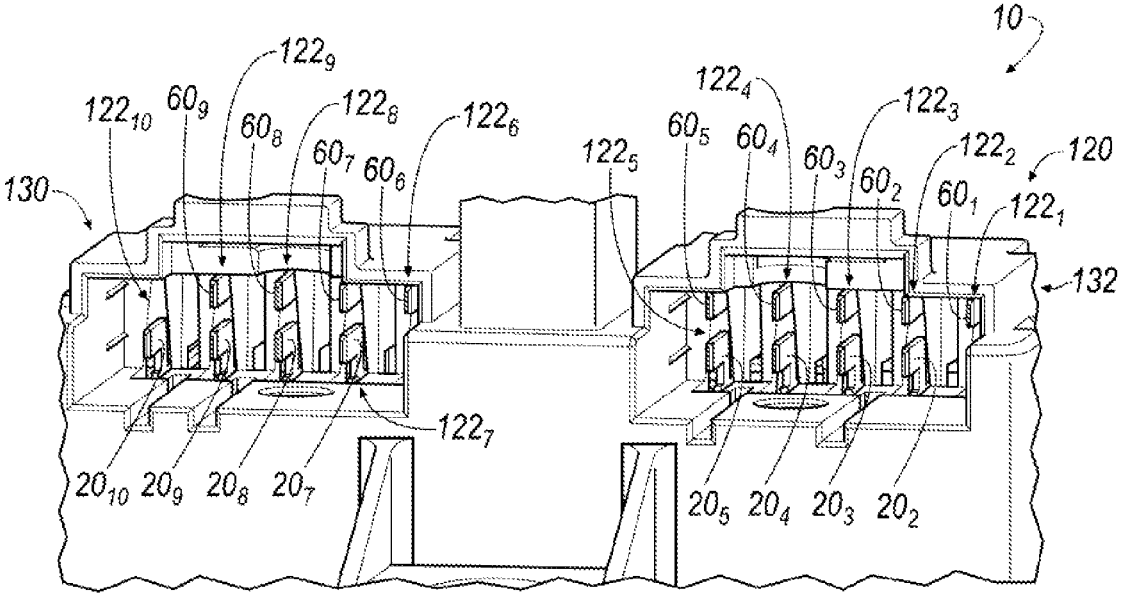
FIGS. 5A and 5B are perspective views of an embodiment of portions of a power distribution box in accordance with teachings of the present disclosure.
Figure 5B:
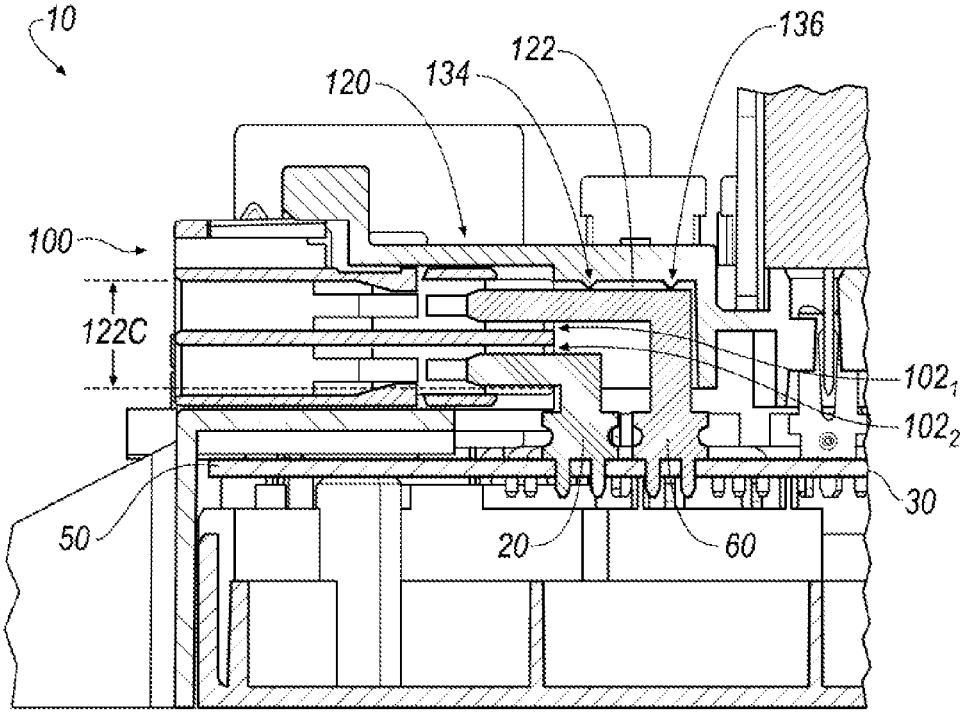

In embodiments, such as generally illustrated in FIGS. 4A and 4B, a power distribution box 10 and/or circuit board 50 may include a cover 120. Cover 120 may include one or more recesses $\mathbf{122}_N$ that may be configured to receive at least a portion of a first terminal 20 and/or a second terminal 60. In embodiments, recesses $\mathbf{122}_N$ may be configured to receive a first terminal 20 and/or a second terminal 60 without the first terminal 20 and/or the second terminal 60 contacting cover 120. For example, and without limitation, a width 122A of a recess $\mathbf{122}_N$ may be wider than a thickness 20A of a first terminal 20 and/or the thickness 60A of second terminal 60, which may or may not be equal. In embodiments, a terminal 20, 60 may include a current rating of at least 5 amps and/or exceeding 5 amps, which may include having a thickness 20A, 60A of at least 0.635 mm, and a width 122A or a corresponding recess $\mathbf{122}_N$ being greater than 0.635 mm. In embodiments, the length 122B of a recesses $\mathbf{122}_N$ may be longer than the length 40B of horizontal portion 40 of first terminal 20 and/or longer than the length 80B of horizontal portion 80 of second terminal 60. In embodiments, a height/depth 122C of a recesses $\mathbf{122}_N$ may be greater than the height/length (e.g., length 22B less length 24B/length 26B) of first terminal 20 and/or the height/length (e.g., length 62B less length 64B/length 66B) of second terminal 60 above circuit board 50 (see, e.g., FIG. 5B). In embodiments, protrusions 134, 136 may extend toward second terminal 60 and/or may contact second terminal 60. In embodiments, contact between protrusions 134, 136 with second terminals may be limited, such as, for example, only at two points, which may be at a top of horizontal portion 80. In embodiments, protrusions 134, 136 and/or any other portion of cover may not contact first terminal 20. In embodiments, first terminals 20 and/or second terminals 60 may extend into recesses 122, but may not extend through any holes/apertures that cover 120 may include. For example, and without limitation, first terminals $\mathbf{20}_N$ and second terminals $\mathbf{60}_N$ may extend into cover 120, but may not extend entirely through cover 120.

In embodiments, such as generally illustrated in FIGS. 4A-5B, cover 120 may include one or more connector portions 130, 132 that may include recesses $\mathbf{122}_N$. In embodiments, connector portions 130, 132 may be configured for receiving and/or engaging an external connector 100. In embodiments, external connector 100 may comprise a wiring harness connector.

In embodiments, a method of assembling power distribution box 10 may include providing a circuit board 50. One or more first terminals 20 may then be connected to circuit board 50, which may include being inserted into corresponding apertures $\mathbf{52}_N$ (e.g., apertures $\mathbf{52}_1$, $\mathbf{52}_2$) of circuit board 50. Then, one or more second terminals $\mathbf{60}_N$ may be connected to and/or inserted into circuit board 50 such that each is disposed over a respective inserted first terminal 20, which may form a plurality of sets $\mathbf{112}_N$ of first and second terminals $\mathbf{20}_N$, $\mathbf{60}_N$. The connected/inserted terminals $\mathbf{20}_N$, $\mathbf{60}_N$ may then be permanently fixed to circuit board 50, such as via soldering. The terminals $\mathbf{20}_N$, $\mathbf{60}_N$ may be inserted such that a gap (e.g., gap 110) exists between each set $\mathbf{112}_N$ of a first terminal $\mathbf{20}_N$ and a second terminal $\mathbf{60}_N$. Cover 120 may then be placed over the set(s) $\mathbf{112}_N$ of inserted terminals such that the first terminals $\mathbf{20}_N$ and/or second terminals $\mathbf{60}_N$ extend into recesses $\mathbf{122}_N$ of connector portions 130, 132 without contacting connector portions 130, 132. Cover 120 may be placed over the set(s) $\mathbf{112}_N$ of inserted terminals vertically (e.g., cover 120 may not need to be tilted and/or slid to fit over the terminals). In embodiments, first terminals $\mathbf{20}_N$ may not contact connector portion 130, 132 and/or second terminals $\mathbf{60}_N$ may only contact one or more protrusions 134, 136 of connector portions 130, 132. In embodiments, protrusions 134, 136 may include generally triangular shapes.

In embodiments, power distribution boxes 10 and/or circuit boards 50 assembled according to the present disclosure may include one or more advantages over conventional designs. For example, and without limitation, conventional designs may rely on inserting terminals into a header and then connecting the entire header to the circuit board. In power distribution boxes 10 and/or circuit boards 50 assembled according to the present disclosure, a header may not be used, which may reduce the cost and/or weight of the power distribution box 10, and/or may reduce assembly complexity. For example, and without limitation, in embodiments, cover 120 may be disposed over terminals $\mathbf{20}_N$, $\mathbf{60}_N$ with a gap 110 between terminals $\mathbf{20}_N$, $\mathbf{60}_N$, and cover may effectively act as a shroud for the terminals $\mathbf{20}_N$, $\mathbf{60}_N$ without contacting the first terminals $\mathbf{20}_N$. In embodiments, the only component between horizontal portions 40, 80 of terminals $\mathbf{20}_N$, $\mathbf{60}_N$ of adjacent sets $\mathbf{112}_N$ (e.g., sets $\mathbf{112}_1$, $\mathbf{112}_2$) may be portions of cover (e.g., a header or portions of a header may not be disposed between adjacent sets $\mathbf{112}_N$).

The foregoing descriptions of specific embodiments of the present disclosure have been presented for purposes of illustration and description. They are not intended to be exhaustive or to limit the present disclosure to the precise forms disclosed, and various modifications and variations are possible in light of the above teaching. It should be understood that references to a single element are also intended to include embodiments that may include more than one of that element or zero of that element. It should also be understood that any example provided is not intended to be exhaustive or limit the disclosure. The embodiments were chosen and described in order to explain the principles of the disclosure and its practical application, to thereby enable others skilled in the art to utilize the disclosure and various embodiments with various modifications, including combinations of features from various embodiments, as are suited to the particular use contemplated.

What is claimed is:

1. A method of assembling a power distribution box, the method comprising:

providing a circuit board;

providing a first L-shaped terminal, the first L-shaped terminal including a horizontal portion and a vertical portion;

providing a second L-shaped terminal, the second L-shaped terminal including a horizontal portion and a vertical portion;

inserting the first L-shaped terminal into the circuit board;

inserting the second L-shaped terminal into the circuit board, after inserting the first L-shaped terminal into the circuit board, such that the horizontal portion of the second L-shaped terminal is disposed above the horizontal portion of the first L-shaped terminal to provide an air gap between the horizontal portion of the first L-shaped terminal and the horizontal portion of the second L-shaped terminal; and providing a power distribution box cover, the power distribution box cover including a recess configured to receive the first L-shaped terminal and the second L-shaped terminal without the power distribution box cover contacting the first L-shaped terminal;

wherein the air gap extends along an entire length of the horizontal portion of the second L-shaped terminal and along an entire length of the vertical portion of the second L-shaped terminal;

wherein the first L-shaped terminal and the second L-shaped terminal each include a plurality of protrusions configured for insertion into the circuit board wherein the first L-shaped terminal and the second L-shaped terminal are not mechanically connected other than via the circuit board.

2. The method of claim 1, further comprising disposing the power distribution box cover over the circuit board such that the first L-shaped terminal and the second L-shaped terminal extend into the recess.

3. The method of claim 1, wherein the power distribution box cover includes a connector portion configured for connection with an external connector; and the recess is provided in the connector portion.

4. The method of claim 1, wherein the first L-shaped terminal includes a middle section and inserting the first L-shaped terminal into the circuit board includes disposing the middle section against a top of the circuit board.

5. A method of assembling a power distribution box, the method comprising:

providing a circuit board;

providing a first L-shaped terminal, the first L-shaped terminal including a horizontal portion and a vertical portion;

providing a second L-shaped terminal, the second L-shaped terminal including a horizontal portion and a vertical portion;

inserting the first L-shaped terminal into the circuit board;

inserting the second L-shaped terminal into the circuit board, after inserting the first L-shaped terminal into the circuit board, such that the horizontal portion of the second L-shaped terminal is disposed above the horizontal portion of the first L-shaped terminal to provide an air gap between the horizontal portion of the first L-shaped terminal and the horizontal portion of the second L-shaped terminal; and providing a power distribution box cover, the power distribution box cover including a first recess configured to receive the first L-shaped terminal and the second L-shaped terminal without the power distribution box cover contacting the first L-shaped terminal;

providing a third L-shaped terminal;

providing a fourth L-shaped terminal;

inserting the third L-shaped terminal into the circuit board; and inserting the fourth L-shaped terminal into the circuit board such that a horizontal portion of the fourth L-shaped terminal is disposed above a horizontal portion of the third L-shaped terminal with an air gap disposed between the horizontal portion of the third L-shaped terminal and the horizontal portion of the fourth L-shaped terminal;

wherein a second recess of the power distribution box cover is configured to receive the third L-shaped terminal and the fourth L-shaped terminal without the power distribution box cover contacting the third L-shaped terminal;

wherein the first L-shaped terminal and the second L-shaped terminal are not mechanically connected other than via the circuit board.

6. The method of claim 5, wherein the air gap extends along an entire length of the horizontal portion of the second L-shaped terminal and along an entire length of the vertical portion of the second L-shaped terminal.

7. A method of assembling a power distribution box, the method comprising:

providing a circuit board;

providing a first L-shaped terminal, the first L-shaped terminal including a horizontal portion and a vertical portion;

providing a second L-shaped terminal, the second L-shaped terminal including a horizontal portion and a vertical portion;

inserting the first L-shaped terminal into the circuit board;

inserting the second L-shaped terminal into the circuit board such that the horizontal portion of the second L-shaped terminal is disposed above the horizontal portion of the first L-shaped terminal to provide an air gap between the horizontal portion of the first L-shaped terminal and the horizontal portion of the second L-shaped terminal; and providing a power distribution box cover, the power distribution box cover including a recess configured to receive the first L-shaped terminal and the second L-shaped terminal without the power distribution box cover contacting the first L-shaped terminal wherein the first L-shaped terminal and the second L-shaped terminal are not mechanically connected other than via the circuit board.

8. The method of claim 1, wherein the first L-shaped terminal and the second L-shaped terminal have current ratings of at least 5 amps.

9. The method of claim 5, further comprising disposing the power distribution box cover over the circuit board such that the first L-shaped terminal and the second L-shaped terminal extend into the first recess and the third L-shaped terminal and the fourth L-shaped terminal extend into the second recess.

10. The method of claim 5, wherein the power distribution box cover includes a connector portion configured for connection with an external connector; and the first recess is provided in the connector portion.

11. The method of claim 5, wherein the first L-shaped terminal includes a middle section and inserting the first L-shaped terminal into the circuit board includes disposing the middle section against a top of the circuit board.

12. The method of claim 11, wherein the air gap includes a first section and a second section; the first section of the air gap extends between the horizontal portion of the first L-shaped terminal and the horizontal portion of the second L-shaped terminal; and, the second section of the air gap extends between the vertical portion of the first L-shaped terminal and the vertical portion of the second L-shaped terminal.

13. The method of claim 12, wherein the air gap includes a third section; the vertical portion of the first L-shaped terminal includes the middle section; the vertical portion of the second L-shaped terminal includes a second middle section; inserting the second L-shaped terminal into the circuit board includes disposing the second middle section against the top of the circuit board; the third section of the air gap extends between the middle section and the second middle section; and the second section of the air gap is wider than the third section of the air gap.

14. The method of claim 5, wherein the first L-shaped terminal and the second L-shaped terminal have current ratings of at least 5 amps.

15. The method of claim 7, wherein the air gap extends along an entire length of the horizontal portion of the second L-shaped terminal and along an entire length of the vertical portion of the second L-shaped terminal.

16. The method of claim 7, further comprising disposing the power distribution box cover over the circuit board such that the first L-shaped terminal and the second L-shaped terminal extend into the recess.

17. The method of claim 7, wherein the power distribution box cover includes a connector portion configured for connection with an external connector; and the recess is provided in the connector portion.

18. The method of claim 7, wherein the first L-shaped terminal and the second L-shaped terminal have current ratings of at least 5 amps.

19. The method of claim 7, wherein the first L-shaped terminal includes a middle section and inserting the first L-shaped terminal into the circuit board includes disposing the middle section against a top of the circuit board.

20. The method of claim 11, wherein the air gap includes a first section, a second section, and a third section; the first section of the air gap extends between the horizontal portion of the first L-shaped terminal and the horizontal portion of the second L-shaped terminal; the second section of the air gap extends between the vertical portion of the first L-shaped terminal and the vertical portion of the second L-shaped terminal; the vertical portion of the first L-shaped terminal includes the middle section; the vertical portion of the second L-shaped terminal includes a second middle section; inserting the second L-shaped terminal into the circuit board includes disposing the second middle section against the top of the circuit board; the third section of the air gap extends between the middle section and the second middle section; and the second section of the air gap is wider than the third section of the air gap.

* * * * *